US008211287B2

(12) United States Patent
Kato et al.

(10) Patent No.: US 8,211,287 B2
(45) Date of Patent: Jul. 3, 2012

(54) SULFURIC ACID ELECTROLYSIS PROCESS

(75) Inventors: Masaaki Kato, Tamano (JP); Yusuke Ogawa, Tamano (JP); Hiroki Domon, Tamano (JP); Naoya Hayamizu, Minato-ku (JP); Makiko Tange, Minato-ku (JP); Yoshiaki Kurokawa, Yokohama (JP); Nobuo Kobayashi, Yokohama (JP)

(73) Assignees: Chlorine Engineers Corp., Ltd., Chuo-ku, Tokyo (JP); Toshiba Corp., Ltd., Minato-ku, Tokyo (JP); Shibaura Mechatronics Corp., Ltd., Yokohama-shi, Kanagawa (JP)

( * ) Notice: Subject to any disclaimer, the term of this patent is extended or adjusted under 35 U.S.C. 154(b) by 560 days.

(21) Appl. No.: 12/459,161

(22) Filed: Jun. 26, 2009

(65) Prior Publication Data

US 2009/0321272 A1 Dec. 31, 2009

(30) Foreign Application Priority Data

Jun. 30, 2008 (JP) ..... 2008-170097

(51) Int. Cl.
*C25B 1/28* (2006.01)

(52) U.S. Cl. ..... 205/472; 205/471

(58) Field of Classification Search ..... 205/471, 205/472

See application file for complete search history.

(56) References Cited

U.S. PATENT DOCUMENTS

2005/0139487 A1* 6/2005 Zwicker et al. ..... 205/701

FOREIGN PATENT DOCUMENTS

JP 11-293484 A 10/1999
JP 2006-278838 A 10/2006
JP 2008-019507 A 1/2008

OTHER PUBLICATIONS

Japan Sulfuric Acid Association, Handbook of Sulfuric Acid, 1968, Japan Sulfuric Acid Association, Japan.

* cited by examiner

*Primary Examiner* — Arun S Phasge
(74) *Attorney, Agent, or Firm* — Chapman and Cutler LLP

(57) ABSTRACT

Sulfuric acid electrolysis process wherein;

a temperature of electrolyte containing sulfuric acid to be supplied to an anode compartment and a cathode compartment is controlled to 30 degree Celsius or more;

a flow rate F1 (L/min.) of the electrolyte containing sulfuric acid to be supplied to said anode compartment is controlled to 1.5 times or more ($F1/Fa \geqq 1.5$) a flow rate Fa (L/min.) of gas formed on an anode side as calculated from Equation (1) shown below and a flow rate F2(L/min.) of said electrolyte containing sulfuric acid to be supplied to said cathode compartment is controlled to 1.5 times or more ($F2/Fc \geqq 1.5$) a flow rate Fe (L/min.) of gas formed on a cathode side as calculated from Equation (2) shown below.

$$Fa=(I\times S\times R\times T)/(4\times \text{Faraday constant}) \quad \text{Equation (1)}$$

$$Fe=(I\times S\times R\times T)/(2\times \text{Faraday constant}) \quad \text{Equation (2)}$$

I: Electrolytic current (A)
S: Time: 60 second (Fixed)
R: Gas constant (0.082 1·atm/K/mol)
K: Absolute temperature (273.15 degree Celsius+T degree Celsius)
T: Electrolysis temperature (degree Celsius)
Faraday constant: (C/mol)

5 Claims, 1 Drawing Sheet

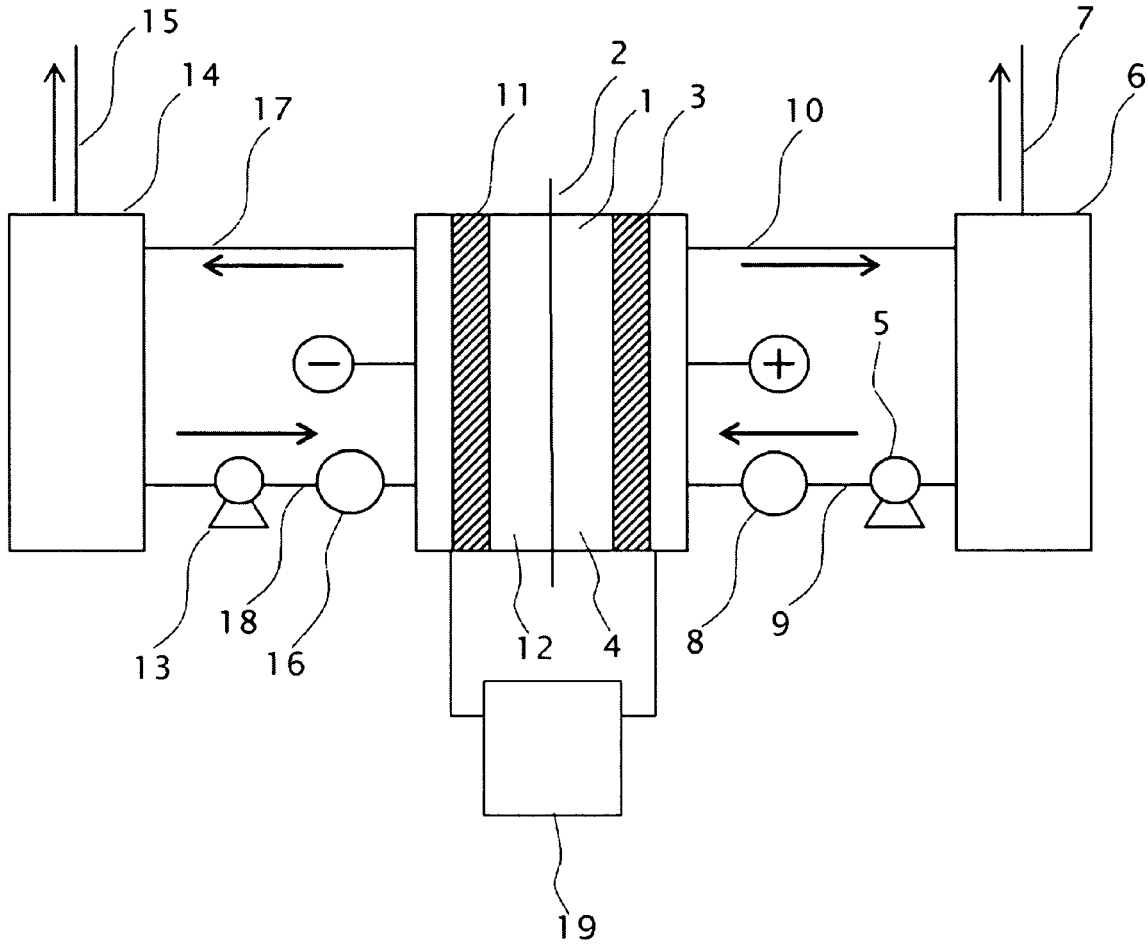
15
14
17
11
2
1
3
10
7
6
5
13
18
16
12
4
8
9
19

SULFURIC ACID ELECTROLYSIS PROCESS

CROSS-REFERENCE TO RELATED APPLICATIONS

This application is based upon and claims the benefit of priority of Japanese Patent Application 2008-170097, filed on Jun. 30, 2008; the entire contents of which are incorporated herein by reference.

BACKGROUND OF THE INVENTION

1. Field of the Invention

The present invention relates to the sulfuric acid electrolysis process which directly electrolyzes concentrated sulfuric acid by using the conductive diamond anode to form oxidizing agent stably.

2. Description of the Related Art

In the so-called wet washing technology, where silicon wafer works are objects of cleaning as seen in the semiconductor device manufacturing, persulfuric acid or persulfate is used as removing agent for used photoresist, metals and organic pollutants. These persulfuric acid or persulfate are known to form through the electrolysis of sulfuric acid, and already manufactured electrolytically on an industrial scale. (Patent Document 1)

Patent Document 1 discloses the method to produce ammonium persulfate through electrolyzing the electrolyte comprising aqueous ammonium sulfate solution. This method applies relatively low concentration of aqueous Sulfate solution at 30-44% by mass. However, electrolysis of the aqueous Sulfate solution at such relatively low concentration as shown in Patent Document 1 reveals a problem that the wash stripping efficiency of photoresist, etc. is low.

In order to solve this problem, the inventors of the present invention have invented, and filed for patent, the sulfuric acid electrolysis process to manufacture persulfuric acid by electrolyzing concentrated sulfuric acid using a conductive diamond electrode, as a technology to supply persulfuric acid with a high cleaning effect, continuously and quantitatively at a high efficiency, and a cleaning process for silicon wafer works applying persulfuric acid manufactured by said process. (Patent Document 2) Compared with platinum electrodes widely used so far as electrodes to form persulfate, this conductive diamond electrode, giving a larger oxygen generation overpotential, shows a higher efficiency in electrolytic oxidation of sulfuric acid into persulfuric acid, is superior in chemical stability and has a longer electrode life.

The process described in Patent Document 2 electrolyzes concentrated sulfuric acid at a concentration over 90% by mass, and the oxidizing agent formed from the electrolysis reaction of concentrated Sulfuric acid, such as peroxomonosulfuric acid, contains less moisture and therefore, is not decomposed through reaction with moisture, capable of stably forming such oxidizing agent as peroxomonosulfuric acid, achieving a high wash stripping efficiency for photoresist, etc.

However, concentrated sulfuric acid has such features derived from its high viscosity with less fluidity, compared with water or relatively thin aqueous solution, that when it is used as an electrolyte for electrolysis, the generated gas from the electrolysis is hard to be liberated from the electrode surface, and also bubbles formed by liberated gas in the electrolyte take time to diffuse and therefore, are difficult to be discharged outside the electrolytic cell. Accordingly, if such gas covers the electrode surface or is contained in the electrolyte plentifully, the resistance between the anode and the cathode increases, raising the cell voltage, which may eventually lead to a phenomenon that electrolytic current will not be supplied in excess of the maximums supply output of the power source, which interferes with the production process of persulfuric acid. Also, other substances than gas formed by electrolysis are easy to precipitate due to its small solubility in the concentrated sulfuric acid, especially at a low temperature. When precipitate, they will also become a factor to interfere with electrolytic current flow as with the case of gas.

In Patent Document 3, the sulfuric acid electrolysis process is disclosed, as a part of the sulfuric acid recycle type cleaning system, which produces persulfuric acid through electrolysis of concentrated sulfuric acid by using the conductive diamond anode. Patent Document 3 also discloses that the formation efficiency of persulfuric acid is raised by controlling the temperature of the solution to be subjected to electrolytic reaction in the range of 10-90 degree Celsius and the rate of dissolution of persulfuric acid solution of the photoresist is increased by controlling the concentration of sulfuric acid to 8M or above, but there is no disclosure about the relationship between the flow rate of the electrolyte and the electrolysis temperature, and neither disclosure nor suggestion are given about the means to perform the sulfuric acid electrolysis stably.

Meanwhile, such troubles have often happened that when in the sulfuric acid electrolysis process to manufacture persulfuric acid using the conductive diamond anode as described in Patent Document 2 and Patent Document 3, electrolytic current value is raised to operate the electrolysis cell, the cell voltage sharply rise beyond the limit of the connected rectifier within a short period of time and the set-up current value sharply descends, causing failure of electrolysis operation. In particular, such trouble of failure in electrolysis was significant when the concentration of concentrated sulfuric acid in said electrolysis was 70% by mass or more and the current density was 20 $A/dm^2$ or more in said electrolysis.

Concentrated Sulfuric acid has a characteristic that its coagulation point varies with concentration; for instance, at 85.66% by mass the point is 7.1 degree Celsius, but at 94% by mass, −33.3 degree Celsius, at 100% by mass, 10.9 degree Celsius, and at 74.36% by mass, −33.6 degree Celsius. It is presumed that to a small variation of concentration, the property changes significantly, and that near the coagulation point, viscosity varies considerably and said troubles tend to easily occur. (Non-Patent Document 1, P. 5-7)

Also, according to Non-Patent Document 1, Pages 5-7, the viscosity of concentrated sulfuric acid is, for instance, 0.99 cP, at 10% by mass of concentration at 30 degree Celsius, being equal to water, but for a high concentration, the value is large, for instance, 7.9 cP at 70% by mass of concentration, 15.2 cP at 80% by mass of concentration, and 15.6 cP at 90% by mass of concentration. Also, the viscosity largely depends on temperature. The lower the temperature, the larger it tends to be. For instance, for 90% by mass of concentration, 31.7 cP at 15 degree Celsius, 23.1 cP at 20 degree Celsius, 15.6 cP at 30 degree Celsius, 11.8 cP at 40 degree Celsius, and 8.5 cP at 50 degree Celsius. In order to promote gas elimination in the region of a high sulfuric acid concentration, applied temperature must be raised, which, however, is known undesirable due to increased decomposition of persulfuric acid.

[Patent Document 1] Tokkaihei 11-293484 Patent Gazette
[Patent Document 2] Tokkai 2008-19507 Patent Gazette
[Patent Document 3] Tokkai 2006-278838 Patent Gazette

[Non-Patent Document 1] Handbook of Sulfuric Acid (published by Japan Sulfuric Acid Association-1968)

SUMMARY OF THE INVENTION

The present invention aims to eliminate the weak points of the conventional technologies described in Patent Documents 1-3 in view of said characteristics of the viscosity and the coagulation point of concentrated sulfuric acid described in Non-Patent Document 1, in particular, the present invention prevents the troubles of electrolytic operation failure during said electrolysis from occurring at 70% by mass or more of concentrated sulfuric acid concentration, and at 20 A/dm$^2$ or more of the current density, by offering the sulfuric acid electrolysis process to form oxidizing agent stably through direct electrolysis of concentrated sulfuric acid by using the conductive diamond anode.

In order to solve said problems, the present invention provides the sulfuric acid electrolysis process in which the anode compartment is separated from the cathode compartment by a diaphragm; the conductive diamond anode is installed in said anode compartment; the cathode is installed in said cathode compartment; electrolyte containing sulfuric acid is supplied for electrolysis to said anode compartment and the cathode compartment, respectively, from outside to generate oxidizing agent in the anolyte in said anode compartment, wherein;

(1) the temperature of said electrolyte containing sulfuric acid to be supplied to said anode compartment and said cathode compartment is controlled to 30 degree Celsius or more;

(2) the flow rate F1 (L/min.) of said electrolyte containing sulfuric acid to be supplied to said anode compartment is controlled to 1.5 times or more (F1/Fa≧1.5) the flow rate Fa (L/m in.) of gas formed on the anode side as calculated from Equation (1) below and the flow rate F2(L/min.) of said electrolyte containing sulfuric acid to be supplied to said cathode compartment is controlled to 1.5 times or more (F2/Fc≧1.5) the flow rate Fc (L/min.) of gas formed on the cathode side as calculated from Equation (2) below.

$$Fa=(I\times S\times R\times T)/(4\times\text{Faraday constant}) \quad \text{Equation (1)}$$

$$Fc=(I\times S\times R\times T)/(2\times\text{Faraday constant}) \quad \text{Equation (2)}$$

1: Electrolytic current (A)
S: Time: 60 second (Fixed)
R: Gas constant (0.082 1·atm/K/mol)
K: Absolute temperature (273.15 degree Celsius+T degree Celsius)
T: Electrolysis temperature (degree Celsius)
Faraday constant: (C/mol)

BRIEF DESCRIPTION OF THE DRAWINGS

FIG. 1. An overall diagram illustrating an example of the sulfuric acid recycle type cleaning system applying the sulfuric acid electrolytic cell by the present invention

DETAILED DESCRIPTION OF THE INVENTION

The following is a detailed explanation about the present invention.

In electrolyzing sulfuric acid directly applying a conductive diamond anode, the inventors of the present invention found that the cell voltage sharply increased for a short period of time beyond the limit of the rectifier, if the electrolytic current value of the electrolysis cell is raised, and the set current value also sharply descended, causing electrolysis operation failure. As such troubles occurred frequently, the inventors discussed in search of possible causes. In particular, operation failure was experienced when the concentration of the concentrated Sulfuric acid in said electrolysis was 70% by mass or more and the current density was 20 A/dm$^2$ or more.

The inventors of the present invention considered that resistance at some part of the electrolytic cell had increased within a short period of time by the start of electrolysis and evaluated the conditions at electrolysis start-up together with the rising trend of cell voltage. As a result, the following findings are obtained.

In the present invention, (1) the temperature of said electrolyte containing sulfuric acid to be supplied to said anode compartment and said cathode compartment is controlled to 30 degree Celsius or more; and (2) the flow rates (F1, F2) of said electrolyte containing sulfuric acid to be supplied to said anode compartment and said cathode compartment is controlled to 1.5 times or more the flow rate F (Fa, Fc) of gas generated on the side of anode and cathode as calculated from the electrolytic current value. In the anode compartment and the cathode compartment, the flow rate of the gas generated on the side of anode and cathode as calculated from the electrolytic current value is obtained from Equation (3), below.

$$F(Fa, Fc)=(I\times S\times R\times T)/(\text{n}\times\text{Faraday constant}) \quad \text{Equation (3)}$$

When n=4, F=Fa
When n=2, F=Fc,
I: Electrolytic current (A)
S: Time: 60 second (Fixed)
R: Gas constant (0.082 1·atm/K/mol)
K: Absolute temperature (273.15 degree Celsius+T degree Celsius)
T: Electrolysis temperature (degree Celsius)
Faraday constant: (C/mol)

If n=4 and n=2 are assigned to Equation (3), Equation (1) and (2) are obtained.

$$Fa=(I\times S\times R\times T)/(4\times\text{Faraday constant}) \quad \text{Equation (1)}$$

$$Fc=(I\times S\times R\times T)/(2\times\text{Faraday constant}) \quad \text{Equation (2)}$$

Moreover, the relationship between the flow rates (F1, F2) of said electrolyte containing sulfuric acid to be supplied to said anode compartment and said cathode compartment and the flow rate (Fa, Fc) of gas generated on the side of anode and cathode as calculated from the electrolytic current value is as below.

$$F1/Fa\geqq 1.5 \quad \text{Equation (4)}$$

$$F2/Fc\geqq 1.5 \quad \text{Equation (5)}$$

Property of Sulfuric acid varies with temperature; however, with the coagulation point, concentrated sulfuric acid shows unique behavior. The present invention was conceived, focusing on the specific properties of concentrated Sulfuric acid that the coagulation point of it significantly varies with the change of concentration even by a few percent by mass and that the viscosity of sulfuric acid, which is extremely large compared with other acids or aqueous solutions, also significantly varies with the change of coagulation point. Moreover, the solubility of concentrated sulfuric acid to various substances is small and at a low temperature, it seems smaller. Also, concentrated sulfuric acid shows a smaller viscosity at a low temperature. Therefore, it is considered that when the electrolyte containing concentrated sulfuric acid is applied, if the electrolyte is at low temperature, substance formed on the electrode surface stays on the electrode surface, without being swiftly carried away from the electrode surface into to the electrolyte, which develops to electrolytic operation trouble. For this reason, the temperature of electrolyte containing concentrated sulfuric acid is required to be controlled to 30 degree Celsius or more.

The present invention has found that it should be avoided for the formed substance to be concentrated on the surface of the electrode as a result of abrupt input of large electrolytic current, and for this reason, the present invention practices the starting procedures of electrolysis in the sequential order of: temperature control of the electrolyte—supply of electrolyte to the electrolytic cell—supply of electrolytic current to the electrolytic cell, and suggests it is preferable that the electrolytic current value is incremented gradually from zero amperes up to the targeted electrolytic current value, by 1 A/sec. or less.

As above-mentioned, when concentrated sulfuric acid is applied, properties of viscosity and coagulation point are essentially important for the stable operation of the concentrated sulfuric acid electrolysis process. In order to lower the viscosity in the highly concentrated region of sulfuric acid and to facilitate gas liberation, raising temperature is necessary, but if it is raised, decomposition of persulfuric acid tends to progress, which is undesirable, and therefore, the maximum temperature should be 70 degree Celsius or below. Also, an increase of water content under a decreased sulfuric acid concentration is not desirable, because such operation not only promotes self-decomposition of persulfuric acid but also impairs the stripping efficiency of photoresist. Higher current density is preferable to improve productivity, but it simultaneously generates Joule heat, promoting self-decomposition of persulfuric acid formed by electrolysis. A desirable temperature ranges for electrolyte is 30-70 degree Celsius.

In case that the electrolyte is circulating between the tank and the electrolytic cell, the temperature of electrolyte is raised by Joule heat with time, therefore, proper provision of a cooling system is required on the circulation line of the electrolyte, such as circulation piping, electrolytic cell and tank, to maintain the temperature of the electrolyte within a proper range. Once the temperature of the electrolyte has risen, the viscosity decreases and the solubility of salt formed by electrolysis increases, but the temperature should be controlled in view of suppression of self-decomposition.

For the production of persulfuric acid, use of a conductive diamond electrode, as anode, with a large oxygen generation overpotential and a high chemical stability is advantageous. If the application is intended for semiconductor manufacturing, such as for photoresist stripping, the conductive diamond electrode is preferable for its less formation of metal impurities from the electrode. As a cathode, any material is applicable as far as it has properties of electric conductivity and sulfuric acid corrosion resistance, such as a conductive diamond electrode, platinum plate and carbon plate.

The flow rate of electrolyte to the electrolytic cell or the flow rate of circulation between the electrode compartment and the tank should be 1.5 times or more the flow rate of generated gas as calculated from the electrolytic current value of the electrolyte, so that generated gas or deposited electrolytic products are removed from the electrode surface and promptly drained outside the electrolytic cell without increasing solution resistance significantly.

In the electrolytic cell, the formation of persulfuric acid by oxidation of sulfuric acid and the reaction of oxygen gas generation are performed at the anode, and the reaction of hydrogen gas generation is performed at the cathode. The current efficiency of persulfuric acid depends on the concentration of sulfuric acid, electrolysis temperature, and current density. In order to enhance the current efficiency of persulfuric acid at the anode, the current density is required to be at 20 A/dm$^2$ or more. If the current density is controlled to 20 A/dm$^2$ or more, electrolytic current not used for the formation of persulfuric acid is used for oxygen generation. The current efficiency for the generation of hydrogen gas at the cathode is almost 100%, and the bubble fraction in the cathode compartment can be controlled by the electrolytic current value and the flow rate of the electrolyte.

Also, the sulfuric acid concentration of said electrolyte containing sulfuric acid to be supplied to said anode compartment is desirably at 70% by mass or more. The oxidizing agent formed from in the electrolysis reaction of concentrated sulfuric acid, such as peroxomonosulfuric acid, contains less moisture and therefore, is not decomposed through reaction with moisture, capable of stably forming such oxidizing agent as peroxomononsulfuric acid, achieving a high wash stripping efficiency for photoresist, etc. In order to raise the wash stripping efficiency of photoresist, etc., the sulfuric acid concentration of said electrolyte containing sulfuric acid to be supplied to said anode compartment is desirably at 70% by mass or more.

Meanwhile, the sulfuric acid concentration of said electrolyte containing sulfuric acid to be supplied to said cathode compartment is desirably the same concentration of said electrolyte containing sulfuric acid to be supplied to said anode compartment. Otherwise, catholyte and anolyte tend to mix through diffusion of mass transfer via a diaphragm, resulting in decreased concentration of oxidizing agent, difficulty in controlling temperature of the electrolytic cell and electrolyte being hindered by appreciable generation of dilution heat, leading to difficulty in forming oxidizing agent stably with time.

The following explains in detail an example of the present invention, in reference to the drawing.

FIG. 1 shows an example of the sulfuric acid electrolytic cell 1 and the sulfuric acid recycle type cleaning system applying the electrolytic cell 1 by the present invention. This electrolytic cell 1 is separated by the diaphragm 2 into the anode compartment 4 accommodating the conductive diamond anode 3 and being filled with concentrated sulfuric acid, and the cathode compartment 12 accommodating the cathode 11 and being filled with sulfuric acid at the same concentration with that in the anode compartment. The system is constructed in such a way that to the anode compartment 4, the anolyte supply line 9 is connected, and through the anolyte supply lines 9 and 10, sulfuric acid, which is anolyte, is circulated between the anode compartment 4 and the anolyte tank 6 by the anolyte circulation pump 5. Similarly, to the cathode compartment 12, the catholyte supply line 18 is connected, and through the catholyte supply lines 18 and 17, catholyte is circulated between the cathode compartment 12 and the catholyte tank 14 by the catholyte circulation pump 13.

Other components include the anode gas vent line 7, the anolyte flow meter & pressure gauge 8, the cathode gas vent line 15, and the catholyte flow meter & pressure gauge 16.

In the present invention, the conductive diamond anode 3 is used as anode and concentrated sulfuric acid is electrolyzed by this conductive diamond anode 3. The conductive diamond anode 3 has a higher oxygen overpotential compared with platinum electrode or lead dioxide electrode (platinum: several hundreds mV; lead dioxide: approx. 0.5V; conductive diamond: approx. 1.4V) and through reaction with water, water is oxidized and oxygen or ozone is generated, as shown in the reaction equations (6) and (7). Moreover, if sulfuric acid ions or hydrogen sulfate ions exist in the anolyte, sulfuric acid ions or hydrogen sulfate ions are oxidized and persulfuric acid ion is generated through reaction with these ions, as shown in the reaction equations (8) and (9).

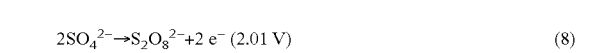

$$2H_2O \rightarrow O_2 + 4H^+ + 4e^- \ (1.23\ V) \quad (6)$$

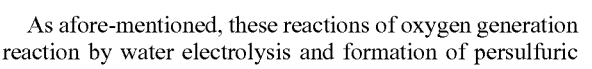

$$3H_2O \rightarrow O_3 + 6H^+ + 6e^- \ (1.51\ V) \quad (7)$$

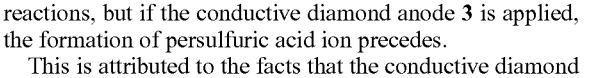

$$2SO_4^{2-} \rightarrow S_2O_8^{2-} + 2e^- \ (2.01\ V) \quad (8)$$

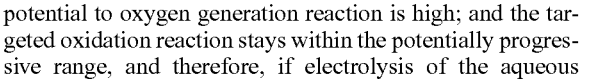

$$2HSO_{4-} \rightarrow S_2O_8^{2-} + 2H^+ + 2e^- \ (2.12\ V) \quad (9)$$

As afore-mentioned, these reactions of oxygen generation reaction by water electrolysis and formation of persulfuric acid ion by oxidation of sulfuric acid ion are competing reactions, but if the conductive diamond anode 3 is applied, the formation of persulfuric acid ion precedes.

This is attributed to the facts that the conductive diamond anode 3 has an extremely broad potential window; the overpotential to oxygen generation reaction is high; and the targeted oxidation reaction stays within the potentially progressive range, and therefore, if electrolysis of the aqueous solution containing sulfuric acid ion is performed, persulfuric acid forms at a high current efficiency, while oxygen generation is only little to occur.

The reason why the oxygen overpotential is high with the conductive diamond anode 3 can be explained as follows. On an ordinary electrode surface, water is first oxidized to form oxygen chemical species and from this oxygen chemical species, oxygen or ozone is considered to be formed. On the other hand, diamond is chemically more stable than ordinary electrode material, and uncharged water is hard to adsorb to the surface and therefore, oxidation of water is considered little to occur. By contrast, sulfuric acid ion, which is anion, is easy to adhere to the surface of diamond, functioning an anode, even at a low potential, and presumably the forming reaction of persulfuric acid ion is more to occur than oxygen generation reaction.

The conductive diamond anode 3 applied under the present invention is manufactured by supporting the conductive diamond film, which is reduction deposit of organic compounds, as carbon source, on the conductive substrate. The material and shape of said substrate are not specifically limited as far as the material is conductive and can be either in plate, mesh, or porous plate, for instance, of bibili fiber sintered body, comprising conductive silicon, silicon carbide, titanium, niobium and molybdenum, and as material, use of conductive silicon or silicon carbide with similar thermal expansion rate is preferable. Moreover, in order to enhance adherence between the conductive diamond film and the substrate, and also to increase surface area of the conductive diamond film to lower current density per unit area, the surface of the substrate should preferably be rough to a certain extent.

When the conductive diamond film is used in membrane, the thickness of membrane should preferably be 10 μm-50 μm to increase durability and to reduce pin-hole development. A self-supported membrane more than 100 μm thick is applicable in view of durability, but cell voltage becomes too high, rendering the temperature control of electrolyte to be more complicated.

The method to support the conductive diamond film to the substrate has no specific limitation and is optional from among conventional methods. Typical manufacturing methods of the conductive diamond film include the hot filament CVD (chemical deposition), microwave plasma CVD, plasma arcjet, and physical vapor deposition method (PVD), with the microwave plasma CVD being desirable in view of a higher film-making rate and uniform film preparation.

Among other applicable is the conductive diamond anode 3 with the conductive diamond film bonded using resin, etc. on the substrate applying synthetic diamond powder manufactured by using ultra-high pressure. In particular, if hydrophobic ingredient, such as fluororesin, is present on the electrode surface, sulfuric acid ion, which is the object of treatment, is easily trapped, leading to enhanced reaction efficiency.

The microwave plasma CVD method is the process in which the hydrogen-diluted mixture gas of carbon source like methane and dopant source like diborane is introduced to the reaction chamber, connected with a microwave transmitter via a waveguide, in which film forming substrate of the conductive diamond anode 3, such as conductive silicon, alumina and silicon carbide is installed, so that plasma is generated within the reaction chamber to develop conductive diamond on the substrate. Ions by microwave plasma do not oscillate, and chemical reaction is effected at a pseudo-high temperature condition where only electrons are made oscillated. Output of plasma is 1-5 kW, the larger the output, the more the active species can be generated and the rate of diamond growth accelerated. Advantage of using plasma lies in the fact that diamond filming is possible at a high speed on a large surface area substrate.

For providing conductivity to the conductive diamond anode 3, a trace amount of elements having different atomic values is added. The content of boron or phosphorus is preferably 1-100000 ppm, or more preferably 100-10000 ppm. As the raw materials for this additive element, boron oxide or phosphorus pentoxide, which is less toxic, is applicable. The conductive diamond anode 3, thus manufactured and supported on the substrate, can be connected to the current collector comprising conductive substances, such as titanium, niobium, tantalum, silicon, carbon, nickel and tungsten carbide, in a configuration of flat plate, punched plate, metal mesh, powder-sintered body, metal fiber, metal fiber-sintered body, etc.

The sulfuric acid electrolytic cell 1 is configured to be a 2-chamber type electrolytic cell, separated into the anode compartment 4 and the cathode compartment 12 by the diaphragm 2 of a reinforced ion exchange membrane or of a porous resin membrane subjected to hydrophilic treatment, so that persulfuric acid icons formed at the conductive diamond anode 3 will not be reduced to sulfuric acid icons through the contact with the cathode 11.

The material of the cell frame of the Sulfuric acid electrolytic cell 1 should preferably be high-temperature-tolerant and high-chemical resistant PTFE or New PFA in view of durability. As the sealing material, porous PTFE, or rubber sheets or O-rings coated with PTFE or New PFA, such as Gore-Tex or Poreflon. Also, for enhancing sealing effect, the cell frame should preferably be v-notched or be given projection processing.

The cathode 11 applied in the present invention is a hydrogen generation electrode or an oxygen gas electrode, necessary to have durability to concentrated sulfuric acid. Applicable materials include conductive silicon, glass-state carbon, and these materials coated with precious metals. In case of an oxygen gas electrode, oxygen supply is controlled to 1.2-10 times of the theoretical amount.

As the diaphragm 2, the neutral membranes, such as trade name—Poreflon, or cation exchange membranes, such as trade names—Nafion, Aciplex, and Flemion are applicable; however, in view of the fact that the product in each compartment can be manufactured separately, use of cation exchange membranes, the latter, is preferable, with an additional advantage that cation exchange membrane can promote electrolysis even when the conductivity of electrolyte is low, such as ultrapure water. To minimize the effect from concentration gradient of water and to decrease the cell voltage, desirable cation exchange membranes include those with packing (reinforcing cloth) with dimensional stability even at a low moisture content; those of 50 μm or less in thickness; and those of no laminated layers of ion exchange membranes. In the coexistence with a substance of low equilibrium vapor pressure, like sulfuric acid at 96% by mass, ion exchange membrane shows a low moisture content and an increased specific resistance value leading to a problem of increased electrolysis cell voltage. When highly-concentrated sulfuric acid like 96% by mass is supplied to the anode compartment 4 to obtain persulfuric acid at a high efficiency, it is desirable to supply sulfuric acid at 70% by mass or below to the cathode compartment 12 in order to supply water to ion exchange membrane.

In the present invention, resin membranes subjected to hydrophilic treatment with IPA (isopropyl alcohol) is applicable as the diaphragm 2, other than ion exchange membranes. Porous fluororesin membranes, other than ion exchange membranes, marketed under the trade names Gore-Tex or Poreflon do not perform electrolysis without hydrophilic treatment, such as with IPA treatment. Said porous fluororesin membranes are hydrophobic and neither permeation of sulfuric acid solution nor proceeding of electrolysis is possible. If this porous fluororesin membrane undergoes hydrophilic treatment, said resin membrane turns to be capable of containing water or concentrated sulfuric acid and electric conduction by sulfuric acid becomes possible, enabling to function as electrolytic cell diaphragm. Porous fluororesin membranes without this treatment keep air in the holes, being unable to conduct electricity, and electrolysis does not proceed. In case that resin membranes subjected to hydrophilic treatment are used as diaphragm, diaphragm itself shows no resistance and electrolysis is performed at a low electrolytic cell voltage, although formed products in both compartments slightly mingle, compared with the case in which ion exchange membranes are used as diaphragm.

Porous alumina plates commonly used as a diaphragm in the production of persulfate are also applicable with enough durability in the electrolytic cell disclosed in the present specifications; however, impurities from porous alumina plates mingle in the electrolyte, and therefore, this type of diaphragm cannot be used for the production of semiconductor cleaning liquid.

This diaphragm 2 can be sandwiched between two sheets of protection board, made of PTFE or new PFA on which holes are punched or in the form of expanded mesh.

The conductive diamond anode 3 has a large oxidative power and organic substance in contact with anodically polarized conductive diamond surface is decomposed to convert to mostly carbon dioxide. The diaphragm 2 in the sulfuric acid electrolytic cell 1 vibrates between the anode and the cathode under the output pressure of the liquid supply pump used for liquid supply to the sulfuric acid electrolytic cell 1 and therefore, if said protection board is not provided, the diaphragm 2 may possibly consume in contact with the conductive diamond anode 3 or the cathode 11. Also, if vibration occurs while the protection board is not provided, the clearance between the electrode and the diaphragm varies and cell voltage may fluctuate.

In the following, the present invention is explained in reference to examples and comparison examples; provided, however, the present invention is not limited to these examples.

Example 1~6

The following gives an example of the operation method of the sulfuric acid electrolytic cell by the present invention.

Two electrodes with the conductive diamond film formed on 6-inch dia. silicon substrates were opposingly installed as anode 3 and cathode 11 with a porous PTFE diaphragm inserted in between. The gap between the electrode and the diaphragm was 6 mm, respectively both for the anode and the cathode to constitute an electrolytic cell, as described in FIG. 1, having an effective electrolysis area of 1 $dm^2$.

Raw material sulfuric acid was stored in the anolyte tank 6 and the catholyte tank 14; sulfuric acid was supplied to the anode compartment 4 and the cathode compartment 12 of the electrolytic cell 1 at a given flow rate by the circulation pumps 5, 13 installed on the lines of the anode side and the cathode side; and electrolysis was performed with electric power supplied across the electrodes. The electrolytic current was supplied from the power source 19, the maximum output of which was 24V. The gas and sulfuric acid electrolytically formed and discharged from the anode compartment and the cathode compartment were introduced to the anolyte tank 6 and the catholyte tank 14 and were subjected to gas-liquid separation. Sulfuric acid after gas-liquid separation was stored temporarily in each tank and returned to the anode compartment 4 and the cathode compartment 11 by the circulation pumps 5, 13, thus performing circulation of the solution in the anode line and in the cathode line, respectively. The gas separated in each tank was discharged outside the system. The flow rate of sulfuric acid supplied to the electrolytic cell 1 was measured by the anolyte flow meter 8 and the catholyte flow meter 16. Sulfuric acid at 98% by mass was diluted to 70-95% by mass with ultrapure water.

Table 1 gives applied experimental conditions and results. The experimental procedures were as follows. Concentrated sulfuric acid at a specified temperature was supplied to the tank; it was circulated at a given flow rate between the tank and the electrode compartment; after acclimating the cell temperature to the sulfuric acid temperature, specified electrolytic current was supplied for 15 minutes at maximum for electrolysis operation. As the supply method of electrolytic current to the electrolytic cell, the electrolytic current value was incremented gradually from zero amperes up to the targeted electrolytic current value, by 1 A/sec. or less. The sulfuric acid concentration, current density, flow rate of sulfuric acid, and temperature of sulfuric acid solution at the electrolysis start were controlled to the specified values as given in Table 1 and the variation of the cell voltage during electrolysis was observed.

TABLE 1

| | sulfuric acid conc. (wt. %) | current density (A/dm2) | F1 (L/min.) | F2 (L/min.) | Fa (L/min.) | Fc (L/min.) | F1/Fa | F2/Fc | max. cell Voltage (V) | *electrolysis possible time (mim.) | anolyte temp. (° C.) | catholyte temp. (° C.) |
|---|---|---|---|---|---|---|---|---|---|---|---|---|
| Example 1 | 95 | 50 | 3.2 | 3.2 | 0.19 | 0.38 | 16.7 | 8.4 | 12 | more than 15 | 33 | 33 |
| Example 2 | 90 | 25 | 3.2 | 3.2 | 0.1 | 0.19 | 33.5 | 16.7 | 9 | more than 15 | 33 | 33 |
| Example 3 | 90 | 50 | 3.2 | 3.2 | 0.19 | 0.38 | 16.7 | 8.4 | 11 | more than 15 | 33 | 33 |
| Example 4 | 90 | 100 | 1.4 | 1.2 | 0.38 | 0.76 | 3.7 | 1.6 | 13 | more than 15 | 33 | 33 |
| Example 5 | 80 | 50 | 3.2 | 3.2 | 0.19 | 0.38 | 16.7 | 8.4 | 10 | more than 15 | 33 | 33 |
| Example 6 | 70 | 50 | 3.2 | 3.2 | 0.19 | 0.38 | 16.7 | 8.4 | 9 | more than 15 | 33 | 33 |

In Table 1,

F1: Volume of anolyte actually flown in the present experiment

F2: Volume of catholyte actually flown in the present experiment

Fa: Flow rate of gas forming on the anode side as calculated from electrolytic current value Fc: Flow rate of gas forming on the cathode side as calculated from electrolytic current value From Table 1, Sulfuric acid concentration: 70-95% by mass F1/Fa and F2/Fc ratio: 1.5 or more in both cases Electrolyte temperature: 33 degree Celsius (Temperature of electrolyte when the electrolyte was supplied inside the tank)

During the experiment, the solution temperature dropped down to 30 degree Celsius by the circulation within the experiment system before the electrolysis operation and warmed up with time after the start of electrolysis by Joule heat.

In Examples 1-6, the cell voltage did not exceed 24 V, without time lapse variation, and stable electrolysis was achieved.

In Table 1,

*"Electrolysis Possible Time" means the time period of electrolysis after setting the electrolysis conditions, during which electrolysis was able to perform at the specified current density.

*"15 minutes or more" means that the electrolysis operation terminated in 15 minutes despite further operation being possible.

COMPARATIVE EXAMPLE 1~9

Comparative Examples 1-6 show the result of electrolysis with a different condition of F2/Fc ratio from those applied in Examples 1-6, the results of which are given in Table 2. In Comparative Examples 1-6, the F2/Fc ratio of all cases give 1 or less and the cell voltage begins to rise almost right after the start of electrolysis, and the current supply becomes impossible.

In Table 2, * "Electrolysis Possible Time" means the time period of electrolysis after setting the electrolysis conditions, during which electrolysis was able to perform at the specified current value. * "15 minutes or more" means that the electrolysis operation terminated in 15 minutes despite further operation being possible. * "NG" means that the cell voltage reaches 24 V or more in the course of increasing the electrolytic current up to the targeted electrolytic current value. Meanwhile, supplied electrolytic current at that time was 0.1 A or less for all cases.

In Comparative Examples 7-9, corresponding to Examples 3, 5, 6, F1/Fa and F2/Fc ratios are both 1.5 or more, but the operation was conducted under the electrolyte temperature at 22 degree Celsius and therefore the electrolysis temperature dropped below 30 degree Celsius. The cell voltage began to rise gradually right after the start of electrolysis, and even in Comparative Example 9 in which the concentration of electrolyte was relatively low as 70% by mass and the viscosity was small, the cell voltage reached 24 V over in 4 minutes after the start of electrolysis.

TABLE 2

| | sulfuric acid conc. (wt. %) | current density (A/dm2) | F1 (L/min.) | F2 (L/min.) | Fa (L/min.) | Fc (L/min.) | F1/Fa | F2/Fc | max. cell Voltage (V) | *electrolysis possible time | anolyte temp. (° C.) | catholyte temp. (° C.) |
|---|---|---|---|---|---|---|---|---|---|---|---|---|
| Comparative Example1 | 95 | 50 | 1.2 | 0.2 | 0.19 | 0.38 | 6.3 | 0.5 | more than 24 | NG | 33 | 33 |
| Comparative Example2 | 90 | 25 | 1.2 | 0.2 | 0.1 | 0.19 | 12.6 | 1 | more than 24 | 10 sec. | 33 | 33 |
| Comparative Example3 | 90 | 50 | 1.2 | 0.4 | 0.19 | 0.38 | 6.3 | 1 | more than 24 | NG | 33 | 33 |
| Comparative Example4 | 90 | 100 | 1.2 | 0.8 | 0.38 | 0.76 | 3.1 | 1 | more than 24 | NG | 33 | 33 |
| Comparative Example5 | 80 | 50 | 1.2 | 0.2 | 0.19 | 0.38 | 6.3 | 0.5 | more than 24 | 20 sec. | 33 | 33 |
| Comparative Example6 | 70 | 50 | 1.2 | 0.2 | 0.19 | 0.38 | 6.3 | 0.5 | more than 24 | 2 min. | 33 | 33 |
| Comparative Example7 | 90 | 50 | 3.2 | 3.2 | 0.19 | 0.38 | 16.7 | 8.4 | more than 24 | NG | 22 | 22 |
| Comparative Example8 | 80 | 50 | 3.2 | 3.2 | 0.19 | 0.38 | 16.7 | 8.4 | more than 24 | 20 sec. | 22 | 22 |
| Comparative Example9 | 70 | 50 | 3.2 | 3.2 | 0.19 | 0.38 | 16.7 | 8.4 | more than 24 | 4 min. | 22 | 22 |

According to the present invention, as described above, if the temperature of the electrolyte is 30 degree Celsius or more and the flow rate of the electrolyte is made 1.5 times or more the flow rate of the gas as calculated from the electrolytic current value, the rise of cell voltage can be suppressed, because the gas or products produced from electrolysis do not remain as insulation material on the electrode surface without liberating, flowing out of the electrolytic cell promptly. Also, according to the present invention, if the starting procedures of the electrolysis follow the sequential order of: temperature control of the electrolyte—supply of electrolyte to the electrolytic cell—supply of electrolytic current to the electrolytic cell, and the electrolytic current value is incremented gradually from zero amperes (A) up to the targeted electrolytic current value, by 1 A/sec. or less, such operation as to increase the concentration of formed products on the electrode surface resulting in the abrupt supply of a large electrolytic current can be eliminated, thus enabling to further suppress the rise of cell voltage. Moreover, according to the present invention, if the sulfuric acid concentration of said electrolyte containing sulfuric acid to be supplied to said anode compartment is controlled to 70% by mass or more, and at the same time, the current density of said electrolysis is controlled to 20 A/dm$^2$ or more, the rise of cell voltage is further more suppressed effectively.

FIGURE LEGEND

1: electrolytic cell
2: diaphragm
3: conductive diamond anode
4: anode compartment
5: anolyte circulation pump
6: anolyte tank
7: anode gas vent line
8: anolyte flow meter & pressure gauge
9, 10: anolyte supply line
11: cathode
12: cathode compartment
13: catholyte circulation pump
14: catholyte tank
15: cathode gas vent line
16: catholyte flow meter & pressure gauge
17, 18: catholyte supply line
19: power source

The invention claimed is:

1. A sulfuric acid electrolysis process used in an electrolytic cell having an anode compartment separated from a cathode compartment by a diaphragm, a conductive diamond anode installed in said anode compartment, and a cathode installed in said cathode compartment, comprising the steps of:

supplying electrolyte containing sulfuric acid for electrolysis to said anode compartment and said cathode compartment, respectively, from outside; and performing electrolysis to generate oxidizing agent in an anolyte in said anode compartment, wherein a temperature of said electrolyte containing sulfuric acid supplied to said anode compartment and said cathode compartment is controlled to be 30 degree Celsius or more;

a flow rate F1 (L/min.) of said electrolyte containing sulfuric acid supplied to said anode compartment is controlled to be 1.5 times or more ($F1/Fa \geqq 1.5$) a flow rate Fc (L/min.) of gas formed on an anode side as calculated from Equation (1) shown below; and a flow rate F2 (L/min.) of said electrolyte containing sulfuric acid supplied to said cathode compartment is controlled to be 1.5 times or more ($F2/Fc \geqq 15$) a flow rate Fc (L/min.) of gas formed on a cathode side as calculated from Equation (2) shown below:

$$Fa=(I\times S\times R\times T)/(4\times \text{Faraday constant}) \quad \text{Equation (1)}$$

$$Fc=(I\times S\times R\times T)/(2\times \text{Faraday constant}) \quad \text{Equation (2)}$$

I: Electrolytic current (A)
S: Time: 60 second (Fixed)
R: Gas constant (0.082 1·atm/K/mol)
K: Absolute temperature (273.15 degree Celsius+T degree Celsius)
T: Electrolysis temperature (degree Celsius)
Faraday constant: (C/mol).

2. The sulfuric acid electrolysis process as defined in claim 1, wherein starting steps of the electrolysis follow a sequential order of: controlling temperature of the electrolyte; supplying electrolyte to the electrolytic cell; and then supplying electrolytic current to the electrolytic cell.

3. The sulfuric acid electrolysis process as defined in claim 1, wherein electrolytic current supplied for said electrolysis step is controlled to have an electrolytic current value that is increased gradually from zero amperes (A) up to a targeted electrolytic current value, by 1 A/sec. or less.

4. The sulfuric acid electrolysis process as defined in claim 1, wherein a sulfuric acid concentration of said electrolyte containing sulfuric acid supplied to said anode compartment is controlled to be 70% by mass or more.

5. The sulfuric acid electrolysis process as defined in claim 1, wherein a current density for said electrolysis is controlled to be 20 A/dm$^2$ or more.

* * * * *